US007963195B2

(12) United States Patent
McRoberts et al.

(10) Patent No.: US 7,963,195 B2
(45) Date of Patent: Jun. 21, 2011

(54) POWERED RATCHET ASSEMBLY

(75) Inventors: Jason McRoberts, Red Lion, PA (US); Terry Turner, Oakland, MD (US); Jennifer Resh, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 186 days.

(21) Appl. No.: 12/197,732

(22) Filed: Aug. 25, 2008

(65) Prior Publication Data

US 2010/0043603 A1 Feb. 25, 2010

(51) Int. Cl.
*B25B 13/46* (2006.01)
*B25B 21/00* (2006.01)

(52) U.S. Cl. ..... 81/57.14; 81/63.2; 81/54

(58) Field of Classification Search ..... 81/57.11, 81/57.14, 52, 54, 60–63.2
See application file for complete search history.

(56) References Cited

U.S. PATENT DOCUMENTS

| | | | | |
|---|---|---|---|---|
| 1,690,018 | A | 10/1928 | Kerfoot | |
| 1,896,949 | A | 2/1933 | Greiner | |
| 1,997,948 | A | 4/1935 | Pearson | |
| 3,149,707 | A | 9/1964 | McInnis | |
| 3,250,158 | A | 5/1966 | Mahall | |
| 3,262,338 | A | 7/1966 | Mahall | |
| 3,349,655 | A | 10/1967 | Locke | |
| 3,674,070 | A | 7/1972 | Mahoney | |
| 3,698,267 | A | 10/1972 | Denney | |
| 3,858,468 | A | 1/1975 | Pasbrig | |
| 4,448,098 | A * | 5/1984 | Totsu | 81/467 |
| 4,887,498 | A | 12/1989 | Zayat | |
| 5,157,995 | A | 10/1992 | Nogues | |
| 5,193,420 | A | 3/1993 | Smith | |
| 5,460,064 | A | 10/1995 | Zayat, Jr. | |
| D368,213 | S | 3/1996 | Marks et al. | |
| 5,622,090 | A | 4/1997 | Marks | |
| 5,644,959 | A | 7/1997 | Howard | |
| D385,762 | S | 11/1997 | Marks | |
| 5,791,209 | A | 8/1998 | Marks | |
| 5,806,385 | A | 9/1998 | Schupp | |
| 5,829,328 | A | 11/1998 | Chen | |
| 5,937,715 | A | 8/1999 | Lin | |
| 5,947,254 | A * | 9/1999 | Jones | 192/223.2 |
| 6,023,999 | A | 2/2000 | Cho | |
| 6,085,619 | A | 7/2000 | Blake et al. | |
| 6,092,443 | A | 7/2000 | Zayat, Jr. | |
| 6,098,507 | A | 8/2000 | Lin | |

(Continued)

OTHER PUBLICATIONS

Black and Decker Automotive Tools and Accessories Catalog Front and Back Covers; Automotive Series Contents; 6080 New ¼" Cordless Ratchet Description and 6090 Cordless Power Driver Description, 4 pages, Copyright 1989.

(Continued)

*Primary Examiner* — D. S Meislin
(74) *Attorney, Agent, or Firm* — Stephen R. Valancius

(57) ABSTRACT

A powered ratchet tool generally includes a housing having a handle portion with a trigger assembly. A motor has an output shaft member that rotates about a longitudinal axis. A ratchet assembly includes a ratchet hub member that connects to the output shaft member. A selector member connects to the ratchet assembly and is operable to change the ratchet assembly between a tighten condition and a loosen condition. A drive member is connected to the ratchet assembly. The drive member rotates about the longitudinal axis about which the ratchet hub member, the selector member and the output shaft member rotates.

19 Claims, 11 Drawing Sheets

U.S. PATENT DOCUMENTS

| | | | |
|---|---|---|---|
| 6,138,534 | A | 10/2000 | Cho |
| D439,481 | S | 3/2001 | Lin |
| 6,272,953 | B1 | 8/2001 | Kant |
| 6,374,710 | B2 | 4/2002 | Kuo |
| 6,467,379 | B1 | 10/2002 | Wizman |
| 6,792,835 | B1 | 9/2004 | Quick et al. |
| 6,928,906 | B1 | 8/2005 | Marks |
| 7,036,402 | B1 | 5/2006 | Marks et al. |
| 2006/0042427 | A1 | 3/2006 | Walters et al. |

OTHER PUBLICATIONS

Parts Diagram and Parts List for 6090 Type 1, 2, 3 and 4, 12 pages, Copyright 2005.

* cited by examiner

POWERED RATCHET ASSEMBLY

FIELD

The present teachings are related to a powered ratchet tool and more particularly related to a powered ratchet tool having an inline drive that can allow a user to power a fastener in a forward or a reverse direction and can also allow the user to hand torque the fastener.

BACKGROUND

Typically, a user can use a power driver to insert a fastener into a wall. Once the user has reached the limit of torque available from the power driver, the user must change tools and use a manual tool to further drive the fastener into the wall. In other instances, the user can use the manual tool to insert the fastener. Whether using a manual tool or switching between a power tool and a manual tool, the time and effort required to insert that fastener can be relatively long.

SUMMARY

The present teachings generally include a powered ratchet tool that includes a housing having a handle portion with a trigger assembly. A motor has an output shaft member that rotates about a longitudinal axis. A ratchet assembly includes a ratchet hub member that connects to the output shaft member. A selector member connects to the ratchet assembly and is operable to change the ratchet assembly between a tighten condition and a loosen condition. A drive member is connected to the ratchet assembly. The drive member rotates about the longitudinal axis about which the ratchet hub member, the selector member and the output shaft member rotates.

Further areas of applicability will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

DETAILED DESCRIPTION

Figure 1:
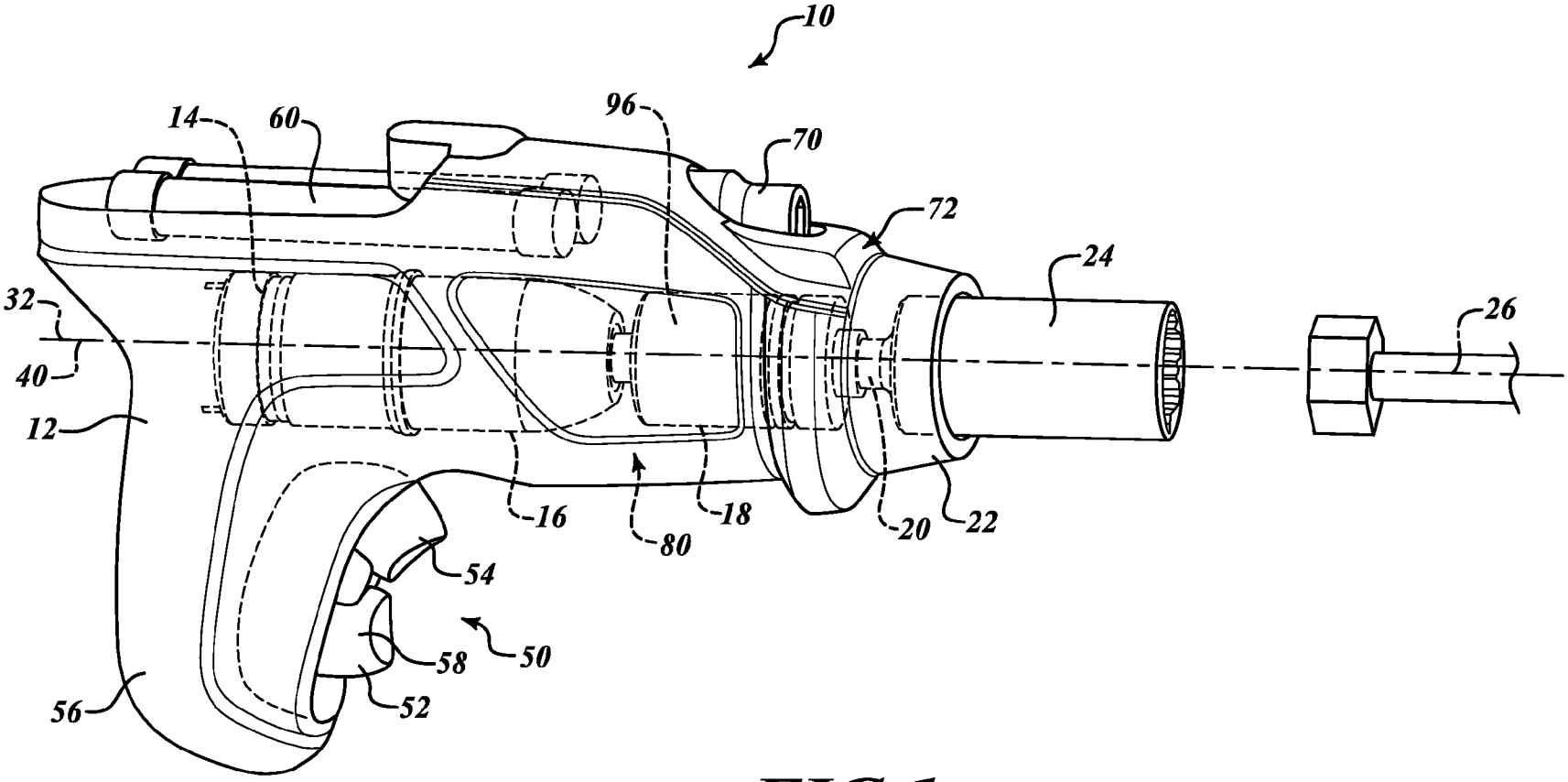
FIG. 1 is a perspective view showing a powered ratchet tool in accordance with the present teachings.

The following description is merely exemplary in nature and is not intended to limit the present teachings, their application or uses. It should be understood that throughout the drawings, corresponding reference numerals indicate like or corresponding parts and features.

Moreover, certain terminology can be used for purposes of reference only and need not limit the present teachings. For example, terms such as "upper," "lower," "above," and "below" can refer to directions in the drawings to which reference is made. Terms such as "front," "back," "rear," and "side" can describe the orientation of portions of the component within a consistent but arbitrary frame of reference which can be made more clear by reference to the text and the associated drawings describing the component under discussion. Such terminology may include the words specifically mentioned above, derivatives thereof and words of similar import. Similarly, the terms "first," "second," and other such numerical terms referring to structures, systems and/or methods do not imply a sequence or order unless clearly indicated by the context.

Figure 17:
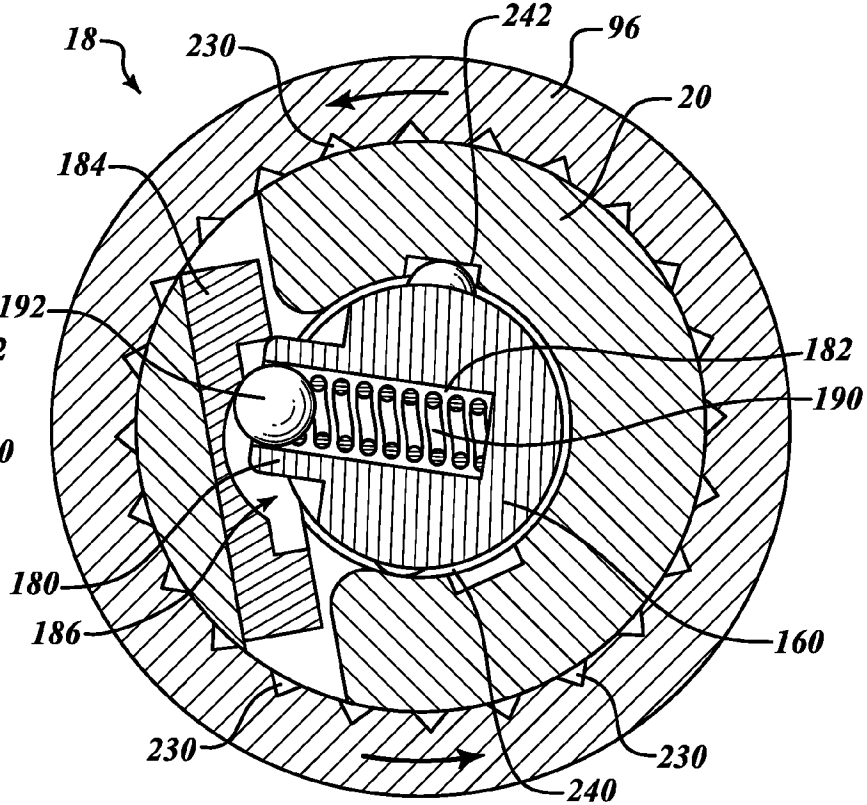
FIG. 17 is similar to FIG. 16 and shows the ratchet hub member in a position where the ratchet hub member has rotated beyond the pawl member and can freely rotate (i.e., ratchet) relative to the drive member in accordance with the present teachings.
Figure 18:
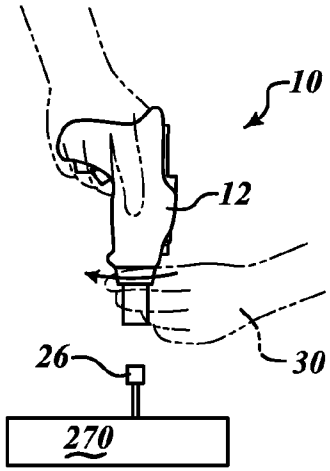
FIG. 18 is a perspective view of a user moving the selector member and the ratchet assembly to the tighten condition in accordance with the present teachings.

In accordance with the various aspects of the present teachings and with reference to FIG. 1, a powered ratchet tool 10 is shown having a housing 12 that can encase a motor 14. The motor 14 can connect to a transmission 16 that can drive a ratchet assembly 18 and can engage and drive a drive member 20. The ratchet assembly 18 can also include a selector member 22 that can adjust the ratchet assembly 18 so torque can be applied to a socket 24 via the drive member 20 in one direction but not in the other direction. Put another way, the ratchet assembly 18 can deliver torque in one direction and ratchet, thus not deliver torque in the opposite direction. It will be appreciated in the light of the present disclosure that these rotational directions can be selectively reversed. As such, the selector member 22 can be moved to a first position that can correspond to a tighten condition. In the tighten condition, the powered ratchet tool 10 can apply torque to the socket 24 to tighten or insert a fastener 26, as shown in FIGS. 17 and 18.

Figure 20:
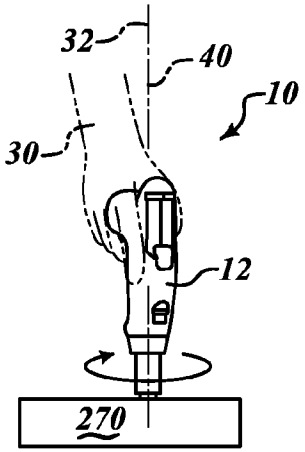
FIG. 20 is a perspective view similar to FIG. 19 and shows the user grasping the housing of the powered ratchet tool and manually driving the fastener with hand torque in accordance with the present teachings.

In the tighten condition, torque applied in a clockwise direction is applied to the socket 24, while torque applied in a counter-clockwise direction is not applied to the socket 24. In this regard, a user 30 can apply torque in the clockwise direction to the socket 24 either by using the motor 14 and the transmission 16, as shown in FIG. 18, or by holding the housing 12 of the powered ratchet tool 10 and applying hand torque in the clockwise direction, as shown in FIG. 20. Moreover, the user 30 can apply the hand torque about an axis of rotation 32 of the powered ratchet tool 10. In doing so, the axis of rotation 32 of the housing 12 can be aligned with a longitudinal axis 40 about which an output shaft 42 of the motor 14, the ratchet assembly 18 and the drive member 20 can rotate. The powered ratchet tool 10 not only can have an inline drive 44 that can drive the drive member 20 about the longitudinal axis 40, the powered ratchet tool 10 can also be grasped and rotated by hand by manually grasping the housing 12 and rotating the powered ratchet tool 10 around the axis of rotation 32 that is aligned with the longitudinal axis of the inline drive 44.

Figure 21:
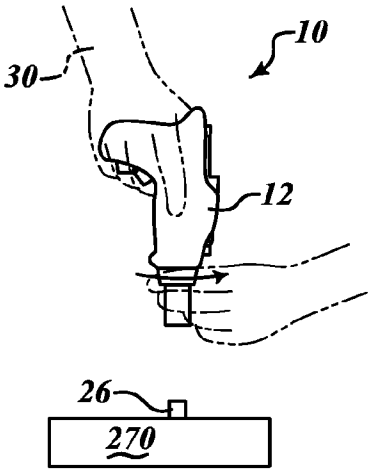
FIG. 21 is a perspective view of the user moving the selector member and the ratchet assembly to the loosen condition in accordance with the present teachings.
Figure 22:
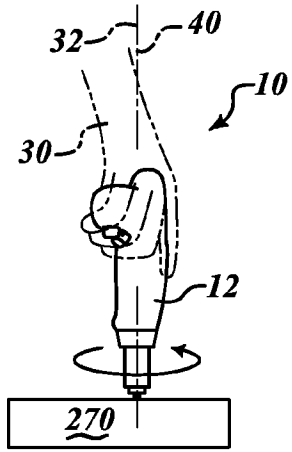
FIG. 22 is a perspective view of the user manually loosening the fastener by rotating the powered ratchet tool with hand torque in accordance with the present teachings.
Figure 23:
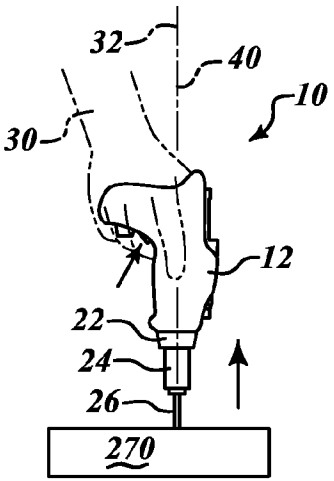
FIG. 23 is a perspective view of the user further loosening the fastener with the socket using the motor of the powered ratchet tool in accordance with the present teachings.

The selector member 22 can be moved to a second position that can correspond to a loosen condition. In the loosen condition, the powered ratchet tool 10 can apply torque to the socket 24 to loosen or remove the fastener 26, as shown in FIGS. 20 and 21. In the loosen condition, torque applied in the counter-clockwise direction is applied to the socket 24, while torque applied in the clockwise direction is not applied to the socket 24. Moreover, the user 30 can apply torque in the counter-clockwise direction to the socket 24 either by using the motor 14 and the transmission 16 as shown in FIG. 21 or by holding the housing 12 of the powered ratchet tool 10 and applying hand torque about the axis of rotation 32 in the counter-clockwise direction as shown in FIG. 20.

The housing 12 can also include a trigger assembly 50. The trigger assembly 50 can include a trigger member 52 that can be rocked from a neutral position to a first position or a second position. In the neutral position, as shown in FIG. 1, the trigger assembly 50 does not activate the motor 14. When a first trigger portion 54 is retracted toward a handle portion 56 of the housing 12, the trigger assembly 50 can move into the first position. The first position of the trigger assembly 50 can be associated with the tighten condition where the trigger assembly 50 can activate the motor 14 to rotate the drive member 20 in the clockwise direction. When a second trigger portion 58 is retracted toward the handle portion 56 of the housing 12, the trigger assembly 50 moves into the second position. The second position of the trigger assembly 50 can be associated with the loosen condition where the trigger assembly 50 can activate the motor 14 to turn the drive member 20 in the counter-clockwise direction. It will be appreciated in light of the disclosure that the first and second positions of the trigger member 52 can be reconfigured to correspond differently to the tighten and the loosen conditions.

The housing 12 can contain one or more batteries 60 that can be inserted to provide power to the powered ratchet tool 10. It will be appreciated in light of the disclosure that the one or more batteries 60 can have similar or different battery chemistries such as a rechargeable battery chemistry including nickel cadmium or lithium ion or a non-rechargeable battery chemistry such as an alkaline battery.

A drive adapter 70 can be disposed and can be removably coupled to a top surface portion 72 of the housing 12. The drive adapter 70 can be near the batteries 60 on the top surface portion 72 of the housing 12. The drive adapter 70 can be removed from the portion 72 of the housing 12 and attached to the drive member 20. The drive adapter 70 can provide an adapter that can change between types of square drives (e.g.: three-eighths inch square drive to one-quarter inch square drive, etc.), types of hex drives (e.g.: three-eighths hex drive to one-quarter inch hex drive, etc.) and combinations thereof (e.g.: three-eighths inch square drive to one-quarter inch hex drive, three-eighths inch square drive to three-eighths inch hex drive, etc.).

Figure 7:
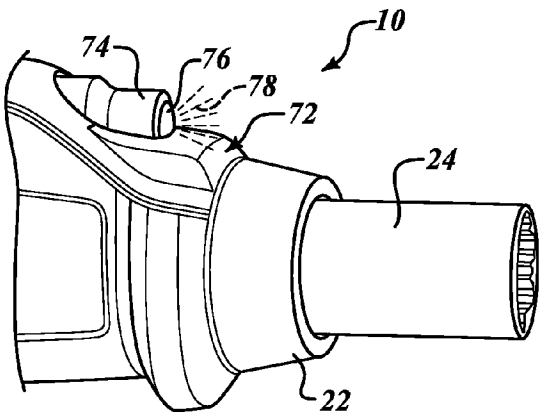
FIG. 7 is a partial perspective view of the powered ratchet tool having a light assembly that emits light to illuminate a workpiece in accordance with the present teachings.
Figure 8:
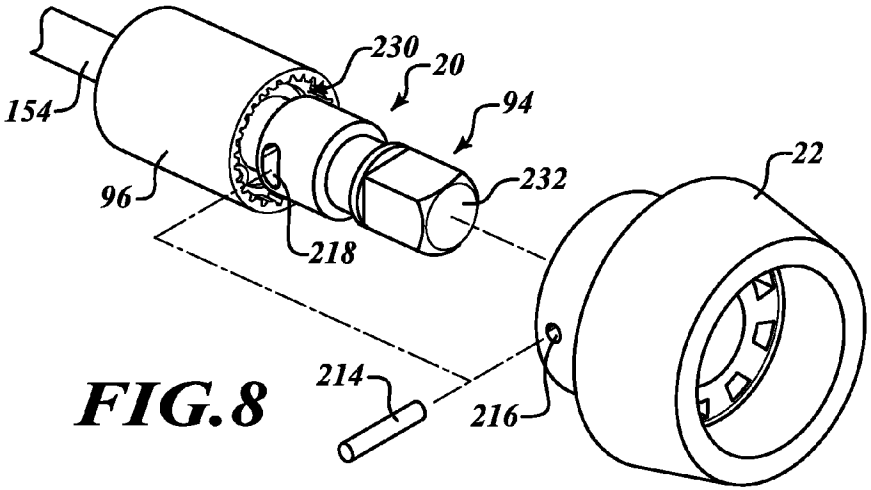
FIG. 8 is a partial exploded assembly view of the ratchet assembly including a selector member and a drive member disposed in the ratchet hub member in accordance with the present teachings.

In another example and with reference to FIG. 7, in lieu of housing 12 holding the drive adapter 70, the housing 12 can include a light assembly 74 having an emitter member 76 can illuminate an area with light 78 where the socket 24 can connect to the fastener 26. The light assembly 74 can be near the batteries 60 on the top surface portion 72 of the housing 12. The light assembly 74 can be activated upon activation of the trigger assembly 50 when the motor 14 is activated to turn in either the clockwise or counter-clockwise direction.

Figure 2:
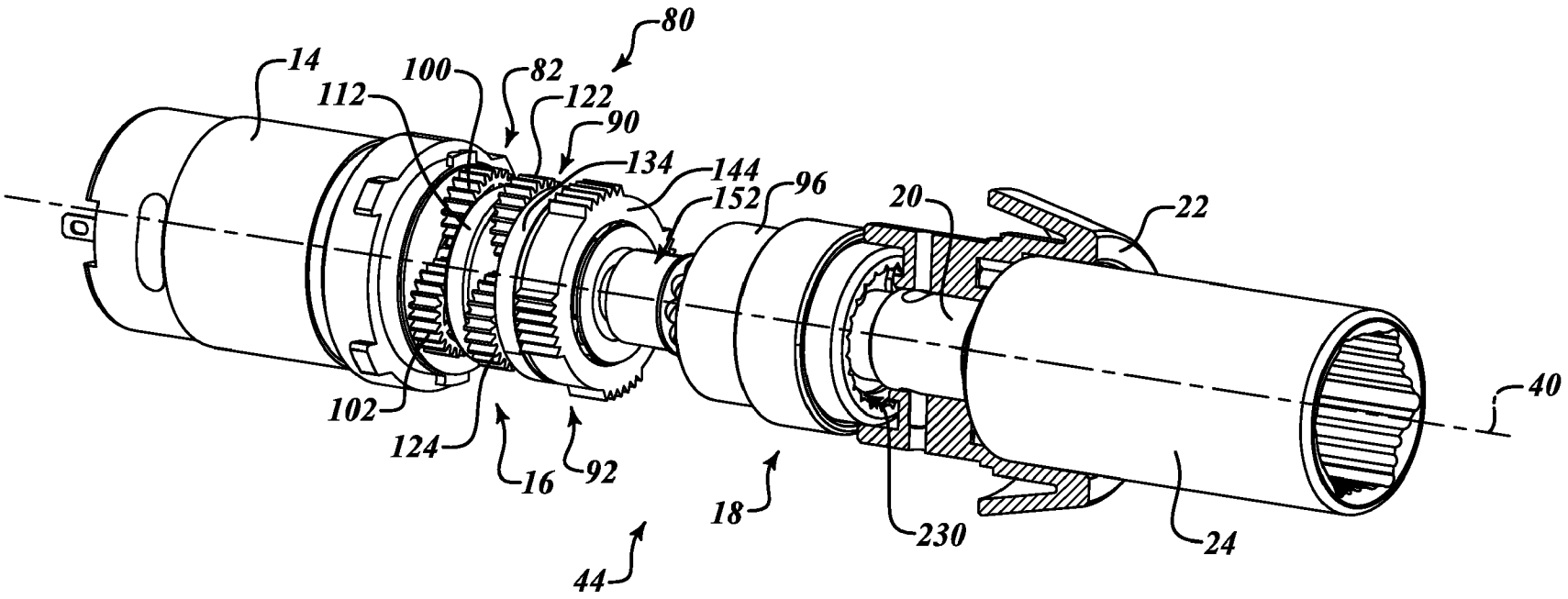
FIG. 2 is a partial side and cross-sectional view of a drive assembly of the powered ratchet tool having an inline drive from a motor to a drive member to which a socket can connect in accordance with the present teachings.

With reference to FIG. 2, a drive assembly 80 providing the inline drive 44 is shown and includes components from the motor 14 to the drive member 20 to which the socket 24 can connect. The motor 14 can connect to the transmission 16. In one example, the transmission 16 can include a two stage planetary gear set. Other types of suitable transmissions can be implemented in the powered ratchet tool 10. For example, a parallel shaft arrangement can be used when the input and the output of the transmission is aligned with the longitudinal axis 40.

The planetary gear set of the transmission 16 can include a first stage 82 that can connect to an input member 84 on an output shaft 86 of the motor 14. The first stage 82 can drive a second stage 90. The second stage 90 can drive the ratchet assembly 18 via a spindle lock assembly 92. As such, the spindle lock assembly 92 can be disposed between the transmission 16 and the ratchet assembly 18. Moreover, the ratchet assembly 18 can be disposed between the spindle lock assembly 92 and a portion 94 of the drive member 20 that can connect to the socket 24. The selector member 22 can be disposed between a ratchet hub member 96 and the socket 24 and can also encircle the drive member 20. Additional details of the spindle lock assembly 92 can be found in commonly assigned U.S. Pat. No. 5,947,254 to Jones filed on Feb. 27, 1997, which is hereby incorporated by reference.

Figure 3:
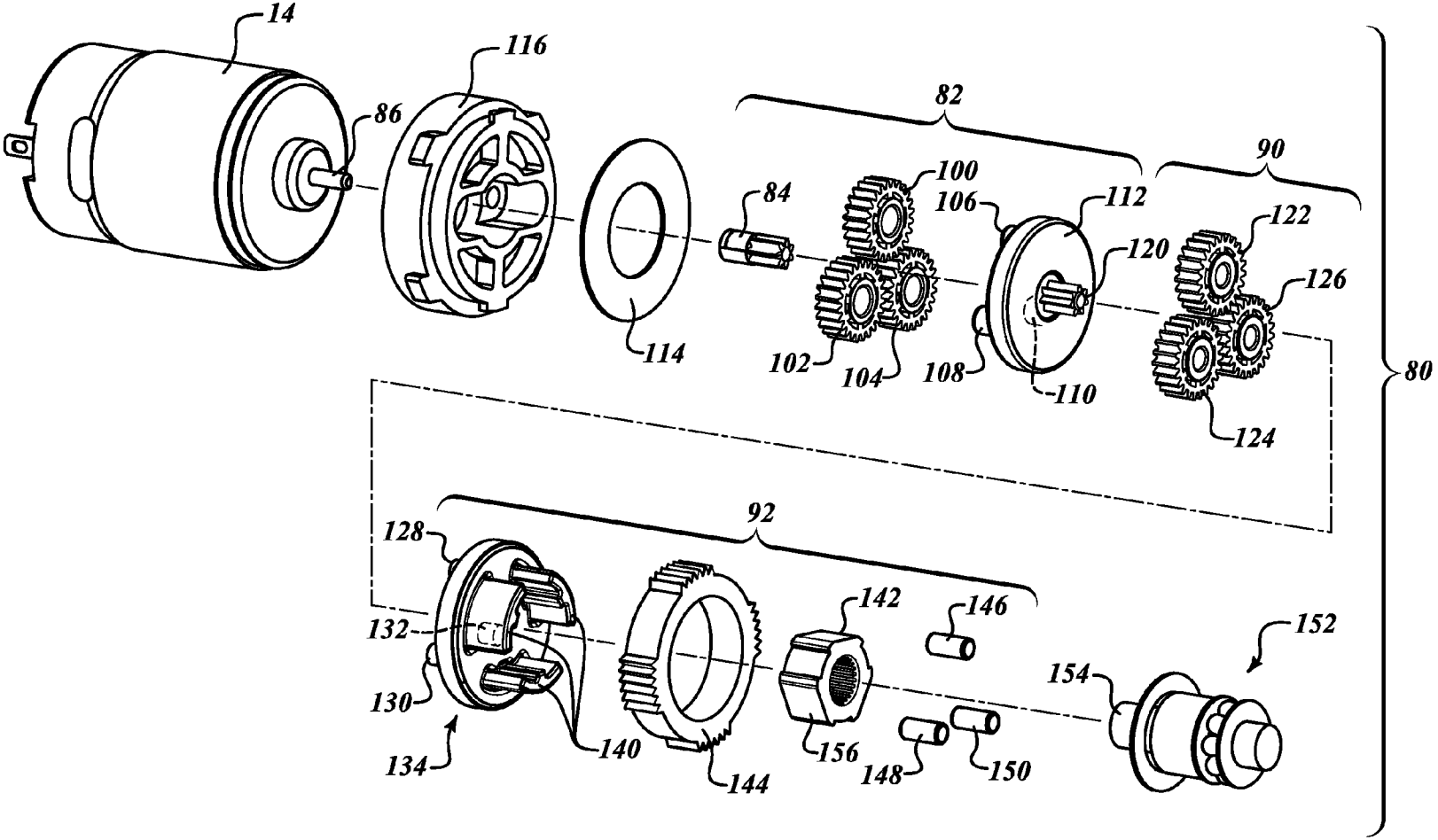
FIG. 3 is a partial exploded assembly view of the drive assembly of FIG. 2 from the motor to a spindle lock assembly in accordance with the present teachings.

With reference to FIG. 3, the output shaft 86 of the motor 14 can connect to the input member 84 that can drive the planetary gears that can be associated with the first stage 82 of the transmission 16. Specifically, the first stage 82 can include three planet gears 100, 102, 104 that can couple for rotation with three respective planet gear pinions 106, 108, 110 that can connect to the first planet carrier 112. The pinion 110 is hidden from view in FIG. 3. The first planet carrier 112 with its three planet gears 110, 102, 104 can be mounted in an abutting relationship against a ring member 114 that can abut a mounting ring member 116 that can hold the motor 14 within the housing 12.

An input pinion 120 can be formed on the first planet carrier 112 that can drive three planet gears 122, 124, 126 of the second stage 90 of the transmission 16. The three planet gears 122, 124, 126 of the second stage 90 can couple for rotation with three respective planet pinions 128, 130, 132 formed on a second planet carrier 134. The pinion 132 is hidden from view in FIG. 3.

Three drive lugs 140 can extend from the second planet carrier 134 and are associated with the spindle lock assembly 92. The spindle lock assembly 92 further includes an anvil member 142 that can be contained within a spindle ring member 144. The three drive lugs 140 that extend from the second planet carrier 134 can interact with the anvil member 142 and three spindle lock pins 146, 148, 150 within the spindle ring member 144 so that torque can be transmitted from the transmission 16 through the spindle lock assembly 92 to the socket 24. The spindle lock assembly 92, however, prevents torque from being transmitted from the socket 24 through the spindle lock assembly 92, which could back-drive the transmission 16 and the motor 14. The spindle lock assembly 92 can connect to the ratchet assembly 18 via a bearing assembly 152.

Figure 4:
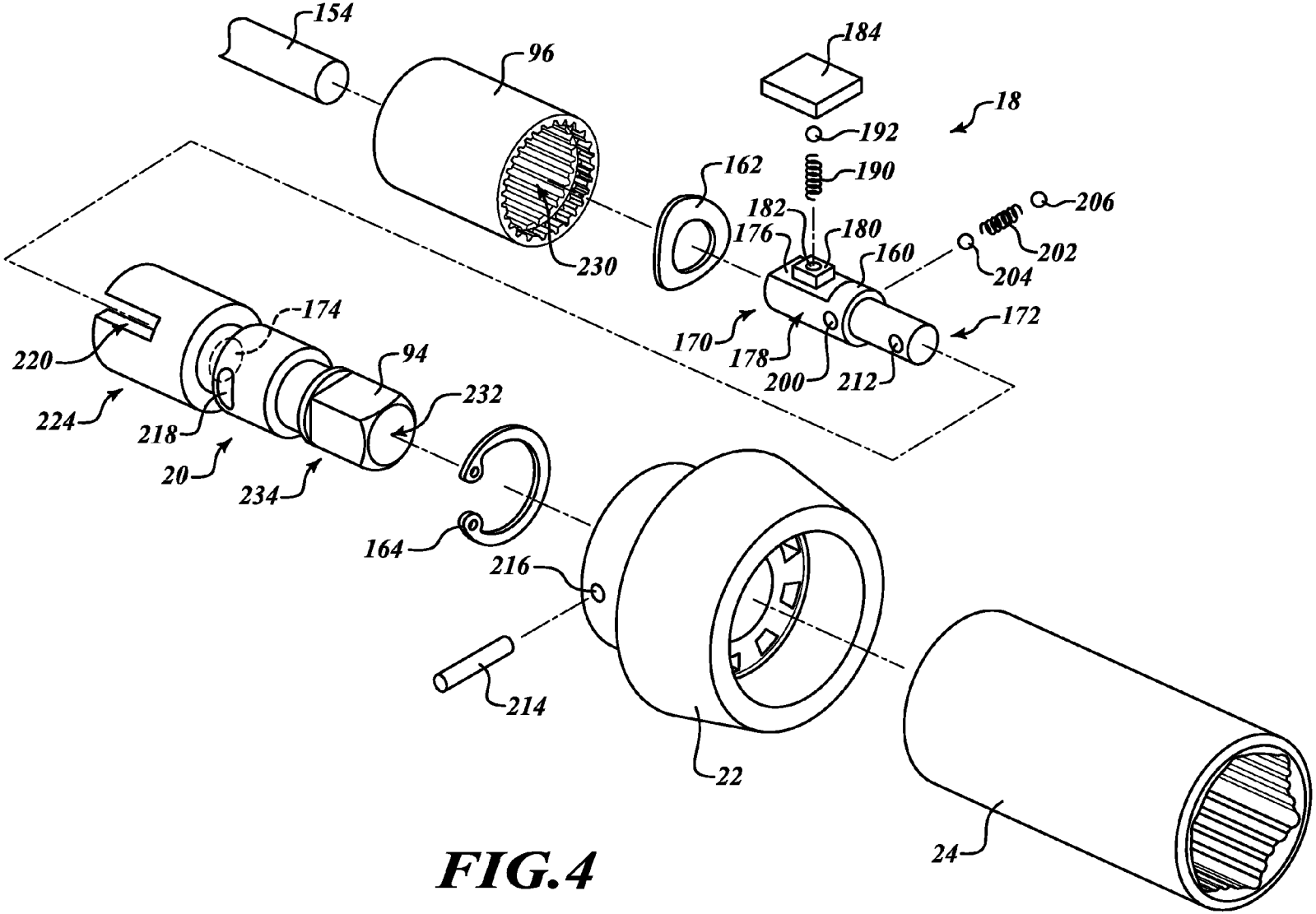
FIG. 4 is a partial exploded assembly view of the drive assembly of FIG. 2 from a ratchet assembly to the socket in accordance with the present teachings.
Figure 6:
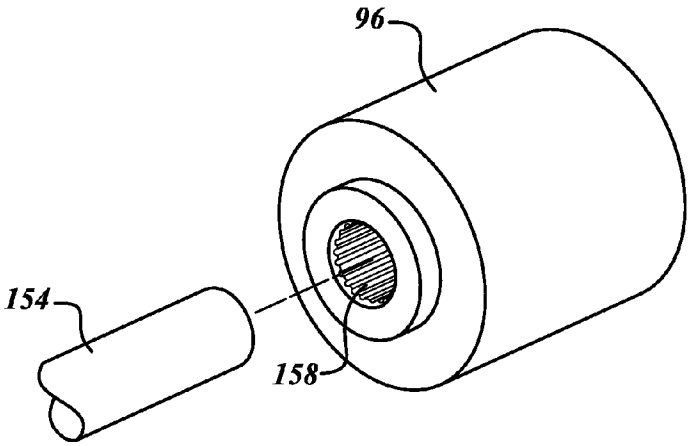
FIG. 6 is a partial perspective view of the member of FIG. 5 and a ratchet hub member of the ratchet assembly of FIG. 4 in accordance with the present teachings.
Figure 5:
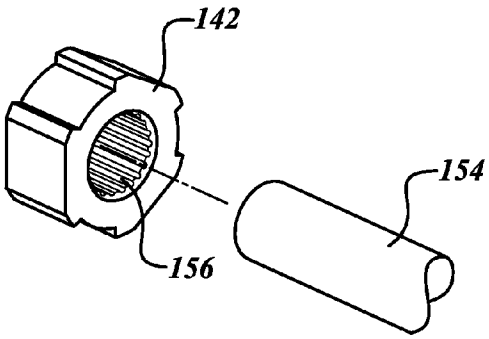
FIG. 5 is a partial perspective view of an anvil member of the spindle lock assembly of FIG. 3 and a member that connects thereto in accordance with the present teachings.

With reference to FIG. 3, a spindle shaft member 154 can extend from the anvil member 142 of the spindle lock assembly 92 and can be connected to the ratchet hub member 96. The spindle shaft member 154 can be connected to the anvil member 142 of the spindle lock assembly 92 with a knurled press fit, as shown in FIG. 4. Specifically, the anvil member 142 can define an aperture 156 having a knurled surface that can accept and fixedly connect to the spindle shaft member 154 that can be press-fit therein. The spindle shaft member 154 can also be connected to the ratchet hub member 96 with a knurled press fit, as shown in FIG. 5. The ratchet hub member 96 can define an aperture 158 having a knurled surface that can accept and fixedly connect to the spindle shaft member 154 that can be press-fit therein.

The drive assembly 80 also includes a selector shaft member 160 that can connect to the selector member 22 and can be disposed within the drive member 20. The selector member 22, by being fixedly connected to the selector shaft member 160, can rotate the selector shaft member 160 while the selector shaft member 160 is disposed within the drive member 20. The selector shaft member 160 can be contained within the drive member 20 and both the selector shaft member 160 and the drive member 20 can be retained within the ratchet hub member 96 against a bias of a wave washer member 162 using a retaining clip member 164.

The selector shaft member 160 has a first end portion 170 and a second end portion 172 with the second end portion 172 having a reduced diameter cross-section when compared to the first end portion 170. In this regard, the second end portion 172 of the selector shaft member 160 can be received within an aperture 174 (FIG. 4) formed within the drive member 20. By accepting the second end portion 172 of the selector shaft member 160 within the aperture 174 of the drive member 20, the selector shaft member 160 can be coupled for rotation with the drive member 20. It will be appreciated in light of the disclosure that the selector shaft member 160 can rotate relative to the drive member 20 and the selector shaft member 160 can rotate with the drive member 20, i.e., no relative motion therebetween.

The first end portion 170 of the selector shaft member 160 can include a planar portion 176 that can interrupt a cylindrical outer periphery 178 (FIG. 9) of the selector shaft member 160. With reference to FIG. 10, the planar portion 176 includes a raised protrusion portion 180. The raised protrusion portion 180 can include an aperture 182. A pawl member 184 can connect to the planar portion 176 of the first end portion 170 of the selector shaft member 160. The pawl member 184 can include an aperture 186 (FIG. 10) that can receive the raised protrusion portion 180 that can extend from the planar portion 176 on the selector shaft member 160.

The aperture 182 formed within the raised protrusion portion 180 can accept a spring member 190 and a ball member 192 such that the ball member 192 can be disposed between the pawl member 184 and the spring member 190. The spring member 190 can impart a force on the pawl member 184 and the ball member 192 to urge the pawl member 184 and the ball member 192 away from the planar portion 176 of the spindle shaft member 160. The ball member 192 and the aperture 186 in the pawl member 184 can permit the pawl member 184 to rock relative to the raised protrusion portion 180. In doing so, the pawl member 184 can form acute angles with the planar portion 176.

In addition, a through hole 200 can be formed in the first end portion 170 of the selector shaft member 160. The through hole 200 can accept a spring member 202 that can be disposed between two ball members 204, 206. The two ball members 204, 206 can be urged by the spring member 202 away from the longitudinal axis 40. In this arrangement, the first end portion 170 of the selector shaft member 160 can be selectively held at certain angular positions relative to (i.e., index against) an inner periphery 210 (FIG. 10) of the drive member 20, as the selector member 22 is able to move the selector shaft member 160 in the drive member 20.

Figure 9:
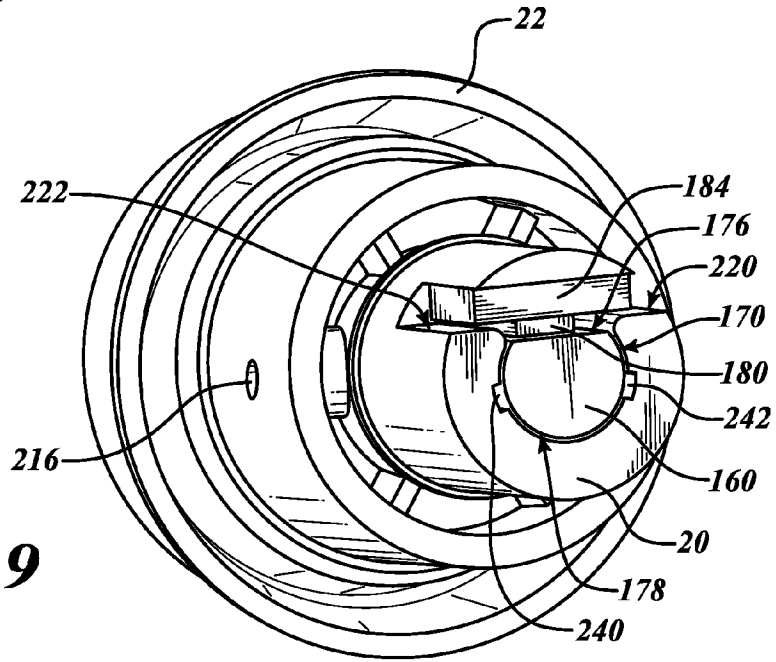
FIG. 9 is a perspective view of a portion of the drive member that can be received in the ratchet hub member in accordance with the present teachings.
Figure 10:
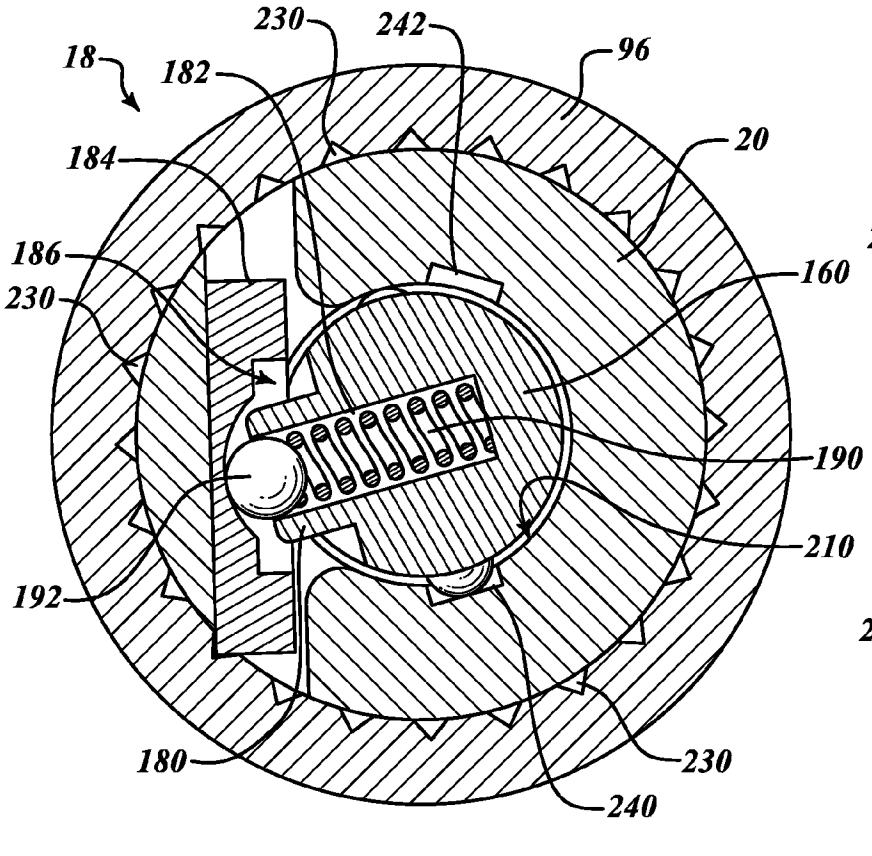
FIG. 10 is a partial cross-sectional view of the ratchet assembly showing a pawl member engaged with internal teeth of the ratchet hub member in a loosen condition so the powered ratchet tool can impart a torque on the socket to loosen a fastener in accordance with the present teachings.

With reference to FIGS. 9 and 10, the second end portion 172 of the selector shaft member 160 can define a through hole 212. The through hole 212 can accept a pin member 214 that can fixedly connect the selector member 22 to the selector shaft member 160. When the selector shaft member 160 is disposed within the drive member 20, the pin member 214 can connect the selector member 22 to the selector shaft member 160 through an aperture 216 formed in the selector member 22 and through an elongated groove 218 formed in the drive member 20. The elongated groove 218 can provide access from the selector member 22 to the selector shaft member 160 through the drive member 20. The elongated groove 218 can also permit the selector member 22 to rotate the selector shaft member 160 relative to the drive member 20.

The pawl member 184 can be positioned in and/or between two grooves 220, 222 (FIG. 9) formed in an end portion 224 of the drive member 20 that can be disposed in the ratchet hub member 96. As such, rotation of the selector shaft member 160 can move the pawl member 184 into and out of engagement with internal teeth 230 formed on the ratchet hub member 96. The pawl member 184 can travel in one of the grooves 220, 222 to make contact with the internal teeth 230.

In one example, a square drive end 232 can be formed on an end portion 234 of the drive member 20 that extends out of the ratchet hub member 96. The square drive end 232 can connect to the socket 24. It will be appreciated in light of the disclosure that the square drive end 232 can be configured in one of many sizes such as a quarter inch drive, a three-eighths inch drive, a half inch drive, etc. It will further be appreciated in light of the disclosure that the square drive end 232 can be configured as a hex drive end or other suitable structure and the drive adapter 70 can be used to switch to a suitable drive end as needed.

Figure 11:
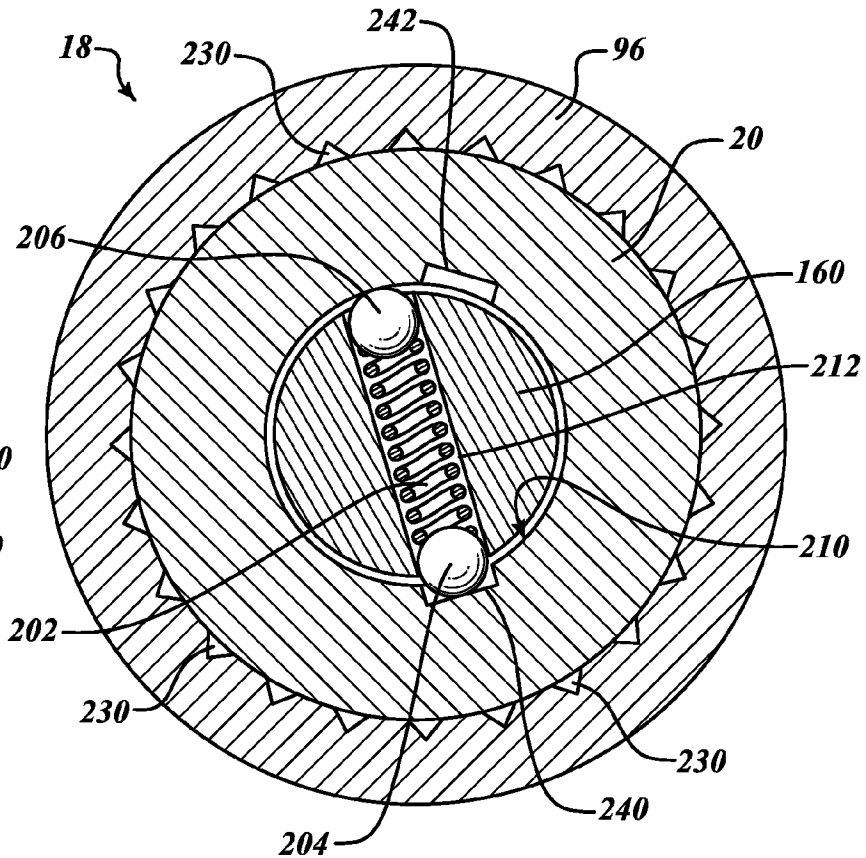
FIG. 11 is a partial cross-sectional view of the ratchet assembly of FIG. 10 showing a selector shaft member that can be indexed against the drive member in the loosen condition in accordance with the present teachings.
Figure 12:
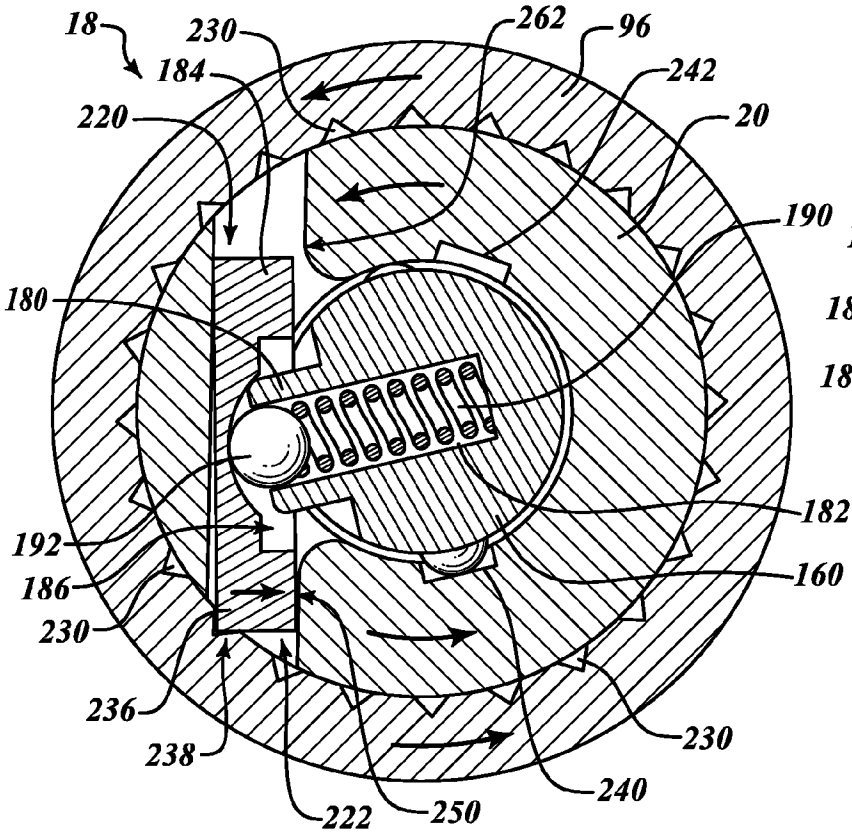
FIG. 12 is similar to FIG. 10 and shows the pawl member held between a shoulder portion of the drive member and the internal teeth of the ratchet hub member to permit driving the socket in a direction that can loosen the fastener in accordance with the present teachings.

FIGS. 10-17 show partial cross-section views of the ratchet assembly 18 with differing positions of the pawl member 184 relative to the internal teeth 230 of the ratchet hub member 96. By placing the pawl member 184 into engagement or out of engagement with the internal teeth 230 of the ratchet hub member 96, the tighten condition or the loosen condition can be implemented so that torque can be applied to the socket 24 in one direction but torque is not applied to the socket 24 when applied in the opposite direction. With reference to FIGS. 10 and 12, the selector shaft member 160 and the pawl member 184 of the ratchet assembly 18 are shown in the loosen condition. In the loosen condition, torque applied to the ratchet hub member 96 in the counter-clockwise direction will cause torque to be applied to the drive member 20 in the counter-clockwise direction, as shown in FIG. 12. In this arrangement, a corner portion 236 of the pawl member 184 can be engaged with the internal teeth 230 of the ratchet hub member 96. An end portion 238 of the pawl member 184 containing the corner portion 236 can extend out of the groove 222 formed in the drive member 20.

With reference to FIG. 11, the selector shaft member 160 can be indexed to a position associated with the loosen condition. The ball members 204, 206 and the spring member 202 can be disposed in the through hole 200 formed in the second end portion 172 of the selector shaft member 160. In this arrangement, the ball member 204 can be urged into a pocket portion 240 formed on the inner periphery 210 of the drive member 20. In doing so, the selector shaft member 160 can be held in a predetermined rotational position relative to the drive member 20. With reference to FIG. 11, the ball member 206, in contrast, can be positioned to only contact the inner periphery 210 of the drive member 20 and is therefore not contained within either of the pocket portions 240, 242.

With reference to FIG. 12, the pawl member 184 can rock about the raised protrusion portion 180 as torque is applied to the ratchet hub member 96. In this regard, the internal teeth 230 of the ratchet hub member 96 can capture the corner portion 236 of the pawl member 184 and can drive the pawl member 184 toward a shoulder portion 250 formed on the drive member 20. At this instance, the pawl member 184 can be squeezed between the internal teeth 230 of the ratchet hub member 96 and the shoulder portion 250 of the drive member 20 allowing the ratchet hub member 96 to directly drive the drive member 20 in the counter-clockwise direction.

Figure 13:
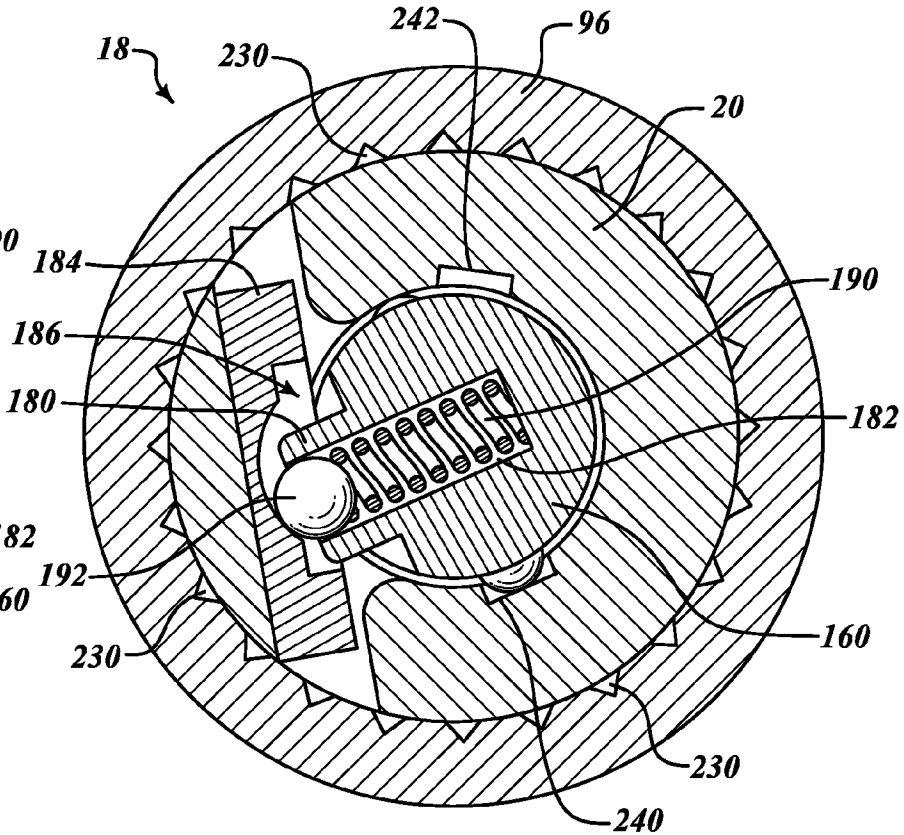
FIG. 13 is a partial cross-sectional view of the ratchet assembly showing the pawl member in a neutral position that allows the ratchet hub member to rotate without engaging and driving the drive member in accordance with the present teachings.

With reference to FIG. 13, the ratchet hub member 96 can be rotated in the clockwise direction, which can cause the internal teeth 230 of the ratchet hub member 96 to disengage from the pawl member 184, as the pawl member 184 can be moved out of an obstructing pathway with the internal teeth 230 of the ratchet hub member 96. It will be appreciated in light of the disclosure that the pawl member 184 can move relative to the selector shaft member 160 and can disengage from the internal teeth 230 of the ratchet hub member 96 without the need for the selector shaft member 160 to move formally between the first or second position, i.e., the tighten or loosened condition. It will further be appreciated in light of the disclosure that moving formally between the first and second positions can mean that one of the ball members 204, 206 can be received in one of the pocket portions 240, 242 that correspond to the tighten or loosen conditions and the pawl member 184 can move relative to the selector shaft member 160 and can disengage from the internal teeth 230 without the need to unseat the one of the ball members 204, 206 from one of the pocket portions 240, 242.

Figure 15:
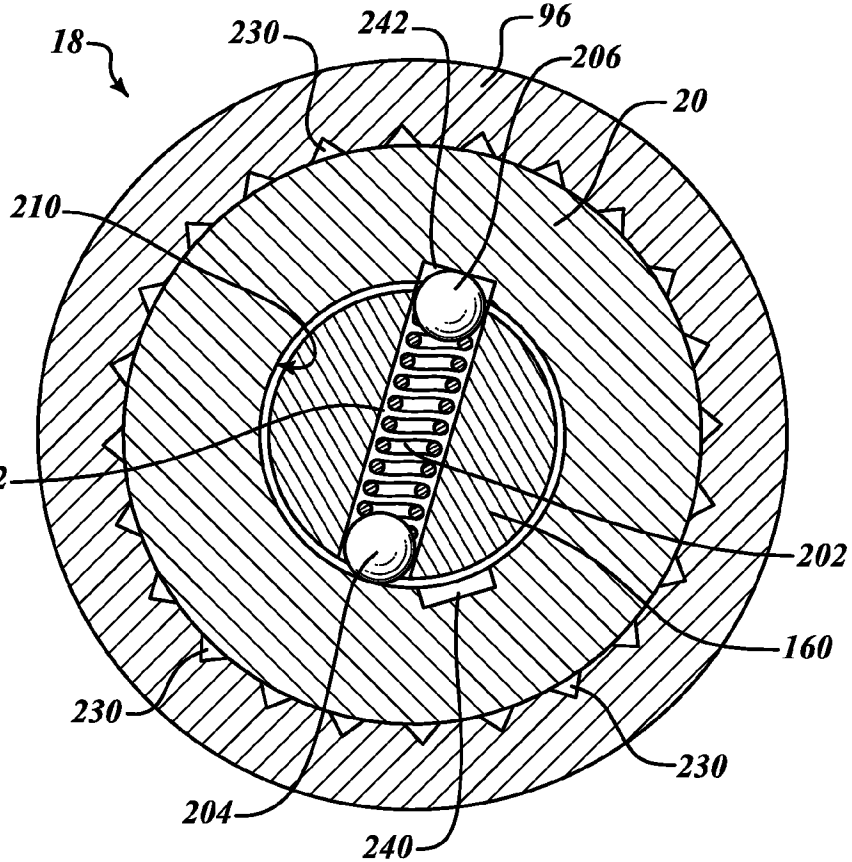
FIG. 15 is a partial cross-sectional view of the ratchet assembly of FIG. 14 showing a selector shaft member that can be indexed against the drive member in the tighten condition in accordance with the present teachings.
Figure 14:
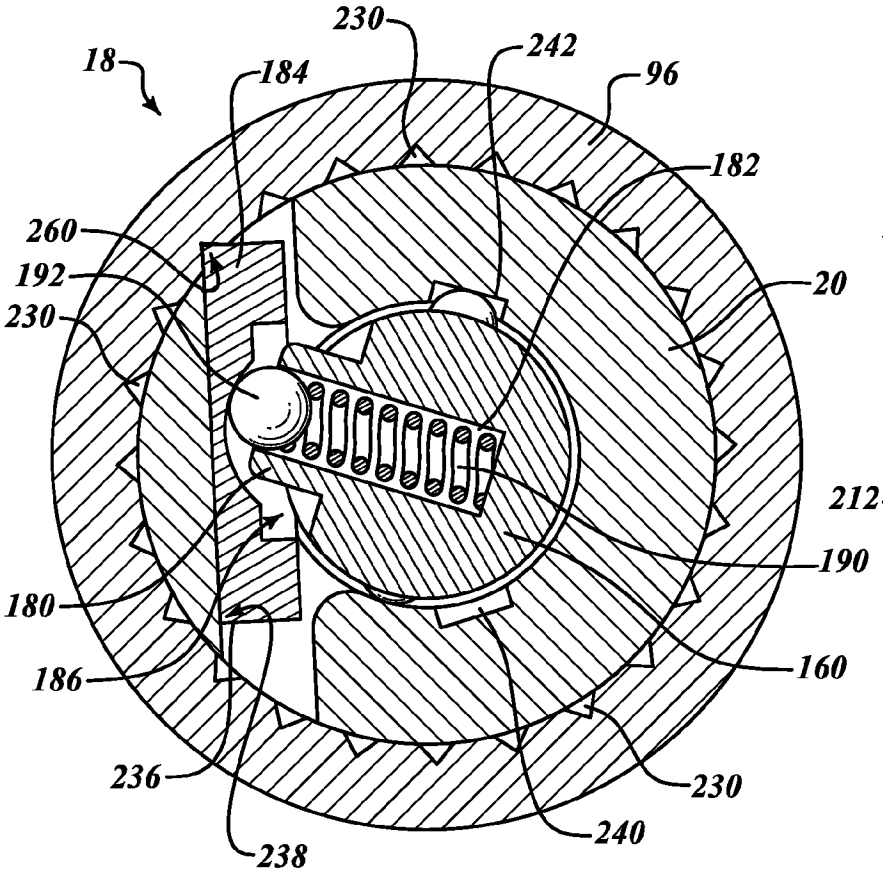
FIG. 14 is a partial cross-sectional view of the ratchet assembly showing the pawl member engaged with internal teeth of the ratchet hub member in a tighten condition so the powered ratchet can impart a torque on the socket and tighten the fastener in accordance with the present teachings.
Figure 16:
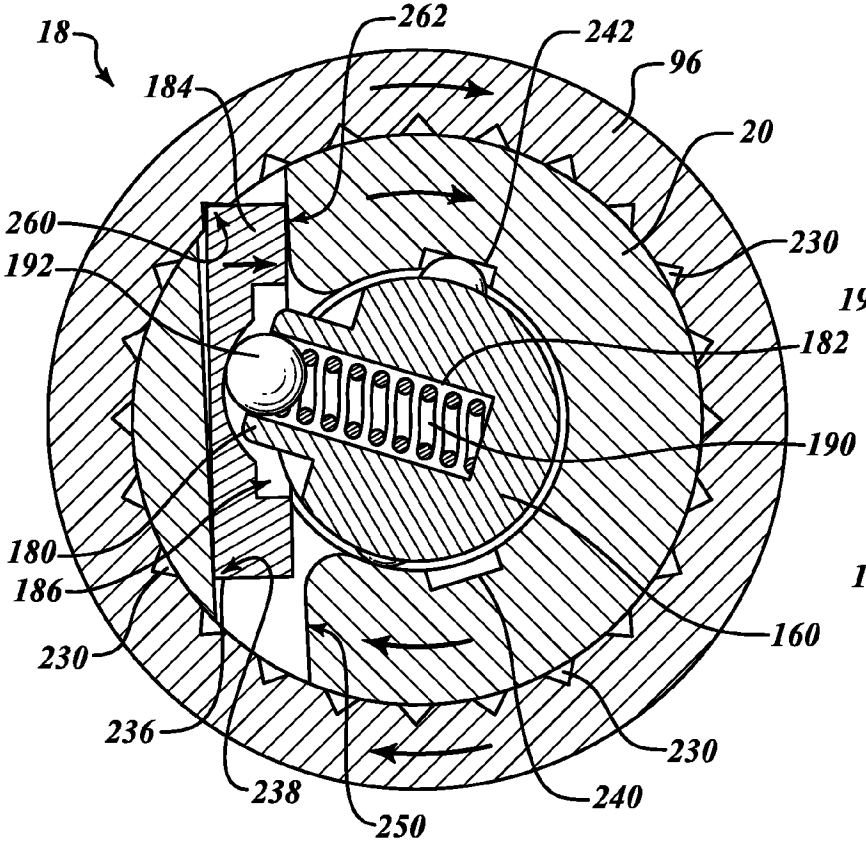
FIG. 16 is similar to FIG. 14 and shows the pawl member held between a shoulder portion of the drive member and the internal teeth of the ratchet hub member to permit driving the socket in a direction that can tighten the fastener in accordance with the present teachings.

With reference to FIG. 14, the selector shaft member 160 can be positioned in the tighten condition. In the tighten condition, torque applied to the ratchet hub member 96 in the clockwise direction can be transferred to the drive member 20 in the clockwise direction, as shown in FIG. 16. A corner portion 260 of the pawl member 184 opposite from the corner portion 236 (FIG. 12) discussed above can be engaged to the internal teeth 230 of the ratchet hub member 96. With reference to FIG. 15, the selector shaft member 160 can be similarly indexed against and held in position relative to the drive member 20. The ball members 204, 206 biased by the spring member 202 can hold the selector shaft member 160 in a position that corresponds to the tighten condition. The ball member 206 can be contained within the pocket portion 242 that corresponds to the tighten condition, while the ball member 204 can be held in contact with the inner periphery 210 of the drive member 20.

With reference to FIG. 16, the ratchet hub member 96 can receive torque in the clockwise direction. The internal teeth 230 of the ratchet hub can engage the corner portion 260 of the pawl member 184 and can move the pawl member 184 down toward a shoulder portion 262 on the drive member 20. In this position, the pawl member 184 can be captured between the internal teeth 230 of the ratchet hub member 96 and the shoulder portion 262 formed on the drive member 20 so that torque from the ratchet hub member 96 can be transferred via the pawl member 184 to the drive member 20.

With reference to FIG. 17, torque can be applied to the ratchet hub member 96 in the counter-clockwise direction and the corner portion 260 of the pawl member 184 can be pushed out of engagement with the internal teeth 230 on the ratchet hub member 96. In this position, the pawl member 184 can permit the ratchet hub member 96 to rotate relative to the drive member 20 and the selector shaft member 160. In this regard, the pawl member 184 has retreated out of an obstructing pathway with the internal teeth 230 of the ratchet hub member 96. In this position, however, the selector shaft member 160 need not move formally between the loosen and the tighten condition to accommodate the ratchet hub member 96 rotating relative to (i.e., ratcheting around) the drive member 20, which is shown in FIGS. 13 and 17.

Figure 19:
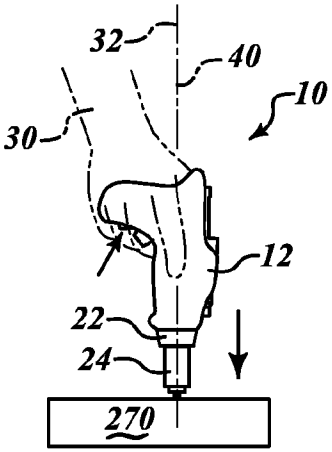
FIG. 19 is a perspective view of the user placing the socket of the powered ratchet tool over the fastener and driving the fastener using the motor of the powered ratchet tool in accordance with the present teachings.

With reference to FIGS. 18-23, the user 30 can use the powered ratchet tool 10 to insert and remove the fastener 26 using the motor 14. In lieu of or in addition to using the motor 14, the user 30 can tighten or loosen the fastener 26 by grasping the housing 12 of the powered ratchet tool 10 and applying hand torque. With reference to FIG. 18, the user 30 can adjust the selector member 22 so that the powered ratchet tool 10 is in the tighten condition. With reference to FIG. 19, the user can place the socket 24 of the powered ratchet tool 10 over the fastener 26. The user 30 can grasp the trigger member 52 of the trigger assembly 50 and can drive the fastener 26 into a workpiece 270 using the motor 14. The motor 14 can tighten the fastener 26 into the workpiece 270 along the longitudinal axis 40 of the powered ratchet tool 10.

In one example, the user 30 can drive the fastener 26 to a sufficient depth and/or tightness using the motor 14. The user 30 can also use the motor 14 of the powered ratchet tool 10 to drive the fastener 26 to a depth just prior to a desired final depth and then can apply hand torque to the fastener 26 with the powered ratchet tool 10 to the desired depth. In another example, the user 30 can drive the fastener 26 with the motor 14 to a point where the motor 14 can no longer provide sufficient torque or sufficient battery life to further drive the fastener 26. In this regard, the user 30 can grasp the housing 12 of the powered ratchet tool 10 and can further drive the fastener 26 with hand torque, as shown in FIG. 20. The user 30 can rotate the powered ratchet tool 10 along the axis of rotation 32 that can be aligned with the longitudinal axis 40 of the inline drive 44 of the powered ratchet tool 10.

It will be appreciated in light of the disclosure that the spindle lock assembly 92 (FIG. 2) can prevent the back-driving of the motor 14 and the transmission 16 and, therefore, can allow the user 30 to directly drive the ratchet assembly 18 by rotating the housing 12 of the powered ratchet tool 10. In addition, by having the ratchet assembly 18 in the tighten condition, hand torque applied to the housing 12 can be directly applied to the drive member 20. In this instance, the user 30 is able to grasp the housing 12 of the powered ratchet tool 10 and rotate the housing 12 relative to the workpiece 270 to drive the fastener 26 further into the workpiece 270.

With reference to FIG. 20, the user 30 can loosen or remove the fastener 26 and can move the selector member 22 to the loosen condition. The user 30 can place the socket 24 of the powered ratchet tool 10 over the fastener 26 and can grasp and rotate the housing 12 of the powered ratchet tool 10 to begin to loosen the fastener. In this regard, the user is able to hand-loosen the fastener 26 in a situation where hand-loosening is preferred or in a situation where the motor 14 is unable to generate enough torque to loosen the fastener 26, whether due to lack of capacity of batteries or power. The hand loosening of the fastener 26 can be accomplished by rotating the housing 12 of the powered ratchet tool 10 about the axis of rotation 32 that aligns with the longitudinal axis 40 of the powered ratchet tool 10.

With reference to FIG. 21, the user 30 can use the motor 14 of the powered ratchet tool 10 to fully remove or additionally loosen the fastener 26. It will be appreciated in light of the disclosure that once the initial loosening of the fastener 26 is accomplished by applying hand torque to the housing 12, the user 30 is able to use the motor 14 of the powered ratchet tool 10 to more quickly remove the fastener 26. There will be some instances, of course, when the motor 14 is capable of fully tightening and/or loosening the fastener 26 and there is no need to provide hand torque in such a direction.

| REF. NO. | ELEMENT |
|---|---|
| 10 | powered ratchet tool |
| 12 | housing |
| 14 | motor |
| 16 | transmission |
| 18 | ratchet assembly |
| 20 | drive member |
| 22 | selector member |
| 24 | socket |
| 26 | fastener |
| 30 | user |

-continued

| REF. NO. | ELEMENT |
|---|---|
| 32 | axis of rotation |
| 40 | longitudinal axis |
| 42 | output shaft |
| 44 | inline drive |
| 50 | trigger assembly |
| 52 | trigger member |
| 54 | first trigger portion |
| 56 | handle portion |
| 58 | second trigger portion |
| 60 | batteries |
| 70 | drive adapter |
| 72 | top surface portion |
| 74 | light assembly |
| 76 | emitter member |
| 78 | light |
| 80 | drive assembly |
| 82 | first stage |
| 84 | input member |
| 86 | output shaft |
| 90 | second stage |
| 92 | spindle lock assembly |
| 94 | portion |
| 96 | ratchet hub member |
| 100 | planet gear |
| 102 | planet gear |
| 104 | planet gear |
| 106 | planet gear pinion |
| 108 | planet gear pinion |
| 110 | planet gear pinion |
| 112 | first planet carrier |
| 114 | ring member |
| 116 | mounting ring member |
| 120 | input pinion |
| 122 | planet gear |
| 124 | planet gear |
| 126 | planet gear |
| 128 | planet gear pinion |
| 130 | planet gear pinion |
| 132 | planet gear pinion |
| 134 | second planet carrier |
| 140 | drive lugs |
| 142 | anvil member |
| 144 | spindle ring member |
| 146 | spindle lock pin |
| 148 | spindle lock pin |
| 150 | spindle lock pin |
| 152 | bearing assembly |
| 154 | spindle shaft member |
| 156 | aperture |
| 158 | aperture |
| 160 | selector shaft member |
| 162 | wave washer member |
| 164 | retaining clip member |
| 170 | first end portion |
| 172 | second end portion |
| 174 | aperture |
| 176 | planar portion |
| 178 | cylindrical outer periphery |
| 180 | raised protrusion portion |
| 182 | aperture |
| 184 | pawl member |
| 186 | aperture |
| 190 | spring member |
| 192 | ball member |
| 200 | through hole |
| 202 | spring member |
| 204 | ball member |
| 206 | ball member |
| 210 | inner periphery |
| 212 | through hole |
| 214 | pin member |
| 216 | aperture |
| 218 | elongated groove |
| 220 | groove |
| 222 | groove |
| 224 | end portion |
| 230 | internal teeth |
| 232 | square drive end |

-continued

| REF. NO. | ELEMENT |
|---|---|
| 234 | end portion |
| 236 | corner portion |
| 238 | end portion |
| 240 | pocket portion |
| 242 | pocket portion |
| 250 | shoulder portion |
| 260 | corner portion |

While specific aspects have been described in the specification and illustrated in the drawings, it will be understood by those skilled in the art that various changes can be made and equivalents can be substituted for elements and components thereof without departing from the scope of the present teachings, as defined in the claims. Furthermore, the mixing and matching of features, elements, components and/or functions between various aspects of the present teachings are expressly contemplated herein so that one skilled in the art will appreciate from the present teachings that features, elements, components and/or functions of one aspect of the present teachings can be incorporated into another aspect, as appropriate, unless described otherwise above. Moreover, many modifications may be made to adapt a particular situation, configuration or material to the present teachings without departing from the essential scope thereof. Therefore, it is intended that the present teachings not be limited to the particular aspects illustrated by the drawings and described in the specification as the best mode presently contemplated for carrying out the present teachings, but that the scope of the present teachings include many aspects and examples following within the foregoing description and the appended claims.

What is claimed is:

1. A powered ratchet tool comprising:

a housing having a handle portion with a trigger assembly;

a motor having an output shaft member that rotates about a longitudinal axis;

a ratchet assembly having a ratchet hub member connected to said output shaft member;

a selector member connected to said ratchet assembly operable to change said ratchet assembly between a tighten condition and a loosen condition;

a drive member connected to said ratchet assembly; and a spindle lock assembly that connects to said ratchet assembly, wherein said drive member rotates about said longitudinal axis about which said ratchet hub member, said selector member and said output shaft member rotates; and wherein the spindle lock assembly includes a spindle shaft member that connects an anvil member of said spindle lock assembly to said ratchet hub member of said ratchet assembly, wherein said anvil member defines an aperture having a knurled surface to provide a knurled press fit between said anvil member and said spindle shaft member of said spindle lock assembly.

2. The powered ratchet tool of claim 1, wherein said housing is operable to drive said drive member in a clockwise direction when a hand torque is applied to said housing in said clockwise direction and when said selector member and said ratchet assembly are in said tighten condition.

3. The powered ratchet tool of claim 2, wherein said housing is operable to rotate in a counter-clockwise direction while said drive member remains stationary when a hand torque is applied to said housing in said counter-clockwise direction.

4. The powered ratchet tool of claim 1, wherein said selector member rotates between a first position and a second position about said longitudinal axis, said first position corresponds to said ratchet assembly being in said loosen condition and said second position corresponds to said ratchet assembly being in said tighten condition.

5. The powered ratchet tool of claim 1, wherein said housing is operable to drive said drive member in a clockwise direction when a hand torque is applied to said housing in said clockwise direction and said selector member and said ratchet assembly are in said tighten condition, said housing rotates about an axis of rotation that is aligned with said longitudinal axis.

6. A powered ratchet tool comprising:

a housing having a handle portion with a trigger assembly;

a motor having an output shaft member that rotates about a longitudinal axis;

a ratchet assembly having a ratchet hub member connected to said output shaft member;

a selector member connected to said ratchet assembly operable to change said ratchet assembly between a tighten condition and a loosen condition;

a drive member connected to said ratchet assembly; and a spindle lock assembly that connects to said ratchet assembly, wherein said drive member rotates about said longitudinal axis about which said ratchet hub member, said selector member and said output shaft member rotates; and wherein the spindle lock assembly includes a spindle shaft member that connects an anvil member of said spindle lock assembly to said ratchet hub member of said ratchet assembly, wherein said ratchet hub member defines an aperture having a knurled surface to provide a knurled press fit between said ratchet hub member of said ratchet assembly and said spindle shaft member of said spindle lock assembly.

7. A powered ratchet tool comprising:

a housing having a handle portion including a trigger assembly;

a motor and a transmission contained in said housing, wherein said trigger assembly is electrically connected to said motor to selectively drive said transmission with said motor;

a ratchet assembly connected to said transmission, wherein said ratchet assembly includes a ratchet hub member having teeth that extend from an inner periphery of said ratchet hub member;

a drive member having a first end portion having a square drive end adapted to couple to a tool and a second end portion defining an aperture and a groove;

a selector shaft member disposed in said aperture of said drive member;

a pawl member connected to said selector shaft member and slidably disposed in said groove between a first position where said pawl member engages said teeth of said ratchet hub member on a first corner portion of said pawl member and a second position where said pawl member engages said teeth of said ratchet hub member on a second corner portion of said pawl member;

a selector member through which said drive member is disposed, wherein said selector member is fixedly connected to said selector shaft member and is operable to rotate said selector shaft member relative to said driver member and move said ratchet assembly between a tighten and a loosen condition.

8. The powered ratchet tool of claim 7 further comprising a wave washer member between said drive member and said ratchet hub member that biases said drive member toward said selector member and away from said handle portion of said housing.

9. The powered ratchet tool of claim 7 further comprising a pin member that fixes said selector member to said selector shaft member through said drive member, wherein an elongated groove formed on said drive member that accepts said pin member is operable to permit said pin member to move between a first position and a second position that corresponds to said tighten condition and said loosen condition, respectively.

10. The powered ratchet tool of claim 9, wherein said selector shaft member indexes against said drive member in said first position and said second position.

11. The powered ratchet tool of claim 7 further comprising a spindle lock assembly disposed between said ratchet hub member and said transmission that permits application of torque to the drive member by rotating said housing of the powered ratchet tool without activation of said motor.

12. The powered ratchet tool of claim 7, further comprising a spindle lock assembly and wherein said spindle lock assembly includes a spindle shaft member that connects to said ratchet hub member with a knurled press fit.

13. The powered ratchet tool of claim 12, wherein said spindle shaft member connects to an anvil member of said spindle lock assembly with a knurled press fit.

14. The powered ratchet tool of claim 7 further comprising an adapter that is operable to connect to said square drive end of said drive member and provide a hex drive on an end of the adapter opposite an end that connects to said square drive end of said drive member, wherein said housing is operable to hold said adapter when said adapter is not connected to said drive member.

15. The powered ratchet tool of claim 7 further comprising: a light assembly connected to said housing that is operable emit light when said motor is activated by said trigger assembly.

16. The powered ratchet tool of claim 1, wherein the spindle lock assembly prevents back-driving of the motor.

17. The powered ratchet tool of claim 16, wherein the spindle lock assembly prevents back-driving of the motor when a hand torque is applied to the housing in a clockwise direction when said selector member and said ratchet assembly are in said tighten condition.

18. The powered ratchet tool of claim 1, further comprising a transmission connected to the motor and wherein the spindle lock assembly is disposed between the transmission and the ratchet assembly.

19. The powered ratchet tool of claim 1, wherein said spindle shaft member connects to said ratchet hub member with a knurled press fit.

* * * * *